United States Patent [19]

Ralston, Jr.

[11] 4,155,829

[45] May 22, 1979

[54] APPARATUS FOR REGULATING ANODE-CATHODE SPACING IN AN ELECTROLYTIC CELL

[75] Inventor: Richard W. Ralston, Jr., Cleveland, Tenn.

[73] Assignee: Olin Corporation, New Haven, Conn.

[21] Appl. No.: 919,530

[22] Filed: Jun. 27, 1978

Related U.S. Application Data

[63] Continuation-in-part of Ser. No. 605,582, Aug. 18, 1975, Pat. No. 4,098,666, which is a continuation-in-part of Ser. No. 489,647, Jul. 18, 1974, Pat. No. 3,900,373, which is a continuation-in-part of Ser. No. 272,240, Jul. 17, 1972, abandoned.

[51] Int. Cl.[2] ..... C25B 15/04; C25B 1/40; C25B 15/02

[52] U.S. Cl. ..... 204/225; 204/228; 204/250

[58] Field of Search ..... 204/225, 219–220, 204/250, 228, 99

[56] References Cited

U.S. PATENT DOCUMENTS

| | | | |
|---|---|---|---|
| 3,558,454 | 1/1971 | Schafer et al. | 204/99 |
| 3,689,398 | 9/1972 | Caleffi | 204/225 X |
| 3,734,848 | 5/1973 | Bertoni et al. | 204/225 X |
| 3,763,024 | 10/1973 | Engelmann et al. | 204/225 X |

*Primary Examiner*—F. C. Edmundson
*Assistant Examiner*—D. R. Valentine
*Attorney, Agent, or Firm*—Donald F. Clements; James B. Haglind

[57] ABSTRACT

An improved method and apparatus for adjusting the space between an adjustable anode and a cathode in an electrolytic cell wherein current measurements and voltage measurements are obtained for conductors to the anode sets and compared with predetermined standards for the same conductors and anode sets. Measurement of deviation from the predetermined standards are used to determine the direction of anode adjustment. A digital computer operably connected to motor drive means adapted to raise or lower anode sets upon appropriate electric signals from the computer is a preferred embodiment of this invention.

12 Claims, 9 Drawing Figures

APPARATUS FOR REGULATING ANODE-CATHODE SPACING IN AN ELECTROLYTIC CELL

This application is a continuation-in-part of co-pending application Ser. No. 605,582, filed Aug. 18, 1975, now U.S. Pat. No. 4,098,666, which was a continuation-in-part of co-pending application Ser. No. 489,647, filed July 18, 1974, now U.S. Pat. No. 3,900,373, issued Aug. 19, 1975, which was a continuation-in-part of abandoned application Ser. No. 272,240, filed July 17, 1972.

The present invention relates to a method and apparatus for adjusting the anode-cathode spacing in an electrolytic cell. In particular, the invention relates to an improved method and apparatus for adjusting the anode-cathode spacing in electrolytic mercury cells for the electrolysis of alkali metal chlorides such as sodium chloride.

In electrolytic cells with adjustable anodes, the control of the inter-electrode distance between the anode and the cathode is economically important. The anode-cathode spacing should be narrow to maintain the voltage close to the decomposition voltage of the electrolyte. Careful control of the anode-cathode spacing reduces energy lost in the production of heat and reduces short circuiting and its accompanying problems which include the destruction of anode surfaces and the contamination of electrolytic products.

Numerous techniques have been developed to adjust the anode-cathode gap in electrolytic cells. For example, U.S. Pat. No. 3,574,073, issued Apr. 6, 1971, to Richard W. Ralston, Jr., discloses adjustment means for anode sets in electrolytic cells. In this patent, a means responsive to changes in the flux of the magnetic field generated by electrical flow in a conductor supplying the anode sets controls the opening and closing of an electrical circuit, and activates hydraulic motors which are effective to raise or lower the anode sets. In addition, a cell voltage signal and a temperature compensated amperage signal proportional to the bus bar current for the anode set are fed as input to an analog computer which produces an output reading of resistance calculated according to the formula:

$$R = E - E_r/I$$

where R is the resistance of one anode set, E is the cell voltage, $E_r$ is the reversible potential of the particular electrode-electrolyte system and I is the current flowing to the anode set. Each anode set has a characteristic resistance at optimum efficiency to which that anode set is appropriately adjusted.

U.S. Pat. No. 3,558,454, which issued Jan. 26, 1971, to Rolph Schafer et al, discloses the regulation of voltage in an electrolytic cell by measuring the cell voltage and comparing it with a reference voltage. The gap between electrodes is changed in accordance with deviations between the measured voltage and the reference voltage and all electrodes in the cell are adjusted as a unit.

Similarly, U.S. Pat. No. 3,627,666, which issued Dec. 14, 1971, to Rene L. Bonfils, adjusts all electrodes in an electrolytic cell using apparatus which measures the cell voltage and current in a series of circuits which regulate the anode-cathode gap by establishing a voltage proportional to U - RI where U is the cell voltage, I the cell current and R the predetermined resistance of the cell.

A method of adjusting electrodes by measuring the currents to individual electrodes in cyclic succession and adjusting the spacing of those anodes whose measured currents differ from a selected range of current values is disclosed in U.S. Pat. No. 3,531,392, which issued Sept. 29, 1970, to Kurt Schmeiser. All electrodes are adjusted to the same range of current values and no measurement of voltage is made.

A method of detecting incipient short circuiting is disclosed in U.S. Pat. No. 3,361,654, which issued Jan. 2, 1968, to D. Deprez et al, by advancing an anode an unknown distance toward the cathode, measuring current as the anode moves and stopping movement of the anode when the current of the cell undergoes a rapid increase disproportionate to the speed of anode advancement, and then reversing the direction of anode movement a selected distance. This method adjusts the electrode with respect to the cell current.

West German Pat. No. 1,804,259, published May 14, 1970, and East German Pat. No. 78,557, issued Dec. 20, 1970, also describe techniques for adjusting the gap between anodes and cathodes.

While the above methods provide ways of adjusting the anode-cathode spacing in an electrolytic cell, it is well known that in a cell containing a plurality of electrodes, the optimum anode-cathode spacing for a particular electrode will depend on its location in the cell, and its age or length of service, among other factors. For example, in a horizontal mercury cell for electrolyzing alkali metal chlorides, the optimum anode-cathode spacing for an anode located near the entry of the cell is different from the spacing for one located near the cell exit. In addition, decomposition voltage varies throughout the cell as brine temperature and concentration change. Likewise a new anode can maintain a closer anode-cathode spacing than one which has been in the cell for a longer period of time or can operate more efficiently at the same spacing. In addition, after an anode has been lowered it is necessary to know whether the anode-cathode spacing is too narrow which may cause short circuiting or loss of efficiency.

There is a need at the present time for an improved method and apparatus for controlling the space between an adjustable anode and a cathode which utilizes current measurements, and/or voltage measurements or a combination thereof to effect adjustment of the electrode space of individual anode sets under the varying conditions occuring in the aforesaid electrolytic cells.

It is an object of this invention to provide an improved method and apparatus for adjusting anode-cathode spacing in an electrolytic cell which overcome disadvantages in previously known techniques for adjusting this spacing.

Objects of this invention are accomplished in an apparatus for adjusting the space between electrodes in an electrolytic cell, said electrodes being comprised of at least one adjustable anode set having at least one conductor conveying current thereto, and a liquid cathode in spaced relationship with said anode set, said apparatus comprising in combination:

a. digital computer means programmed with predetermined standard signal ranges for voltage signals and current signals for each of said anode sets,
b. means for detecting voltage signals and current signals to each conductor to each anode set,
c. means for selecting from said detected signals a set of signals generated from each conductor to a selected anode set, d. means for placing said selected signals in digital form and supplying said selected signals to said digital computer means, e. means for comparing said selected signals with said predetermined standard signal ranges for said selected anode set programmed in said computer, f. means in said digital computer for generating activating electric signals when said detected signals are outside of said predetermined standard signal ranges, and g. motor means operative to raise and lower said selected anode set, said motor means being energized by said activating electric signals when said detected signals are outside said standard signal ranges.

In preferred embodiments the apparatus of this invention also has in combination:

h. means for reactivating said means b. through g. immediately after said motor means is activated to lower said anode set, i. means for storing the previously detected signals obtained prior to lowering said selected anode set and means for comparing newly detected signals with said previously detected signals, j. means for detecting analog type voltage signals produced by each conductor carrying current to each anode set, k. means for compensating said signals for temperature variations in said conductors to produce signals that are proportional to the current flow in said conductor, l. means for detecting analog type voltage signals across said anode set, m. means for selecting from said compensated signals a set of signals generated from the conductors carrying current to a selected anode set in said electrolytic cell, n. means for amplifying said set of signals, o. means for transforming the thus amplified set of signals at cell potential into proportional signals at computer potential, p. means for conditioning said proportional signals to remove rectifier-generated noise, q. means for converting the thus conditioned signals of the analog type to signals of the digital type, r. means for calculating the voltage coefficient from said digital type signal according to the formula:

$$\text{Voltage coefficient} = V - D/KA/M^2$$

where V is the overall voltage across said anode set in which said set of signals is generated, D is the decomposition voltage of the cell, and $KA/M^2$ is the current density in kiloamperes per square meter of cathode surface below said selected anode set.

s. means for comparing the thus calculated voltage coefficients with a predetermined voltage coefficient for said anode set in said cell and determining the difference between said calculated voltage coefficient and said predetermined voltage coefficient, t. means for comparing the digital type current signals with a predetermined current for each conductor to each anode set in said cell and determining the difference between said measured current and said predetermined current, u. motor means operative to raise and lower by a predetermined amount said anode set fed by the conductor in which said signals are detected, said motor means being energized by electric signals from said computer to raise said anode set when said calculated voltage coefficient is below said predetermined voltage coefficient by an amount in excess of k, a predetermined limit, or said measured current is higher than said predetermined current, said differences exceed a predetermined limit, and said motor means being energized to lower said anode set when said calculated voltage coefficient is higher than said predetermined voltage coefficient by more than said k, v. means for activating said means j. through q. immediately after said motor means is activated to lower said anode set and means for comparing the new signals proportional to current flow in each conductor feeding said anode set with the signals proportional to current flow to said anode set prior to lowering said anode set, w. means for activating said motor means to raise said anode set by a predetermined amount when the increase in current following said lowering of the said anode set exceeds a predetermined amount, x. means for activating said means b. through g. when the increase in current is less than said predetermined amount, but continues to increase unless said current exceeds a second predetermined limit, means for activating said motor means to raise said anode set by a predetermined amount when the current exceeds said second predetermined limit, y. means for activating said motor means to raise said anode set by a predetermined amount when said current continues to increase for longer than a predetermined period of time, and z. means for activating said motor means to raise said anode set a predetermined amount when the frequency of change in anode-cathode spacing over a predetermined period exceeds a predetermined limit.

The objects of this invention are also accomplished in a mercury cell circuit having a plurality of flowing mercury amalgam cathode electrolytic cells in series, each of said cells being electrically connected to the cells adjacent thereto by bus bars, and a control circuit having a storable program digital computer characterized by the improvement comprising shunts responsive to current flow on each of said bus bars; and first level multiplexing means and second level multiplexing means interposed between said bus bars and said storable program digital computer.

Objects of this invention are also accomplished in the novel method and apparatus of this invention wherein an electrolytic cell is used containing an electrolyte decomposable by electric current, said electrolyte being in contact with electrodes comprised of at least one adjustable anode set and a liquid cathode spaced apart a predetermined distance. A voltage is applied across the cathode and anode set through at least one conductor to the anode set to develop an electric current flow from said anode set through said electrolyte to said cathode to effect decomposition of the electrolyte. In the operation of this electrolytic cell, the improved method and apparatus of this invention comprises:

a. operably connecting to the adjustable anode set a motor drive means adapted to raise and lower the adjustable anode set upon receipt of electric signals from a digital computer, b. means for obtaining N current measurements of the current to each conductor to the anode set over a predetermined period, and means for conveying each current measurement by electric signal to the computer, c. means for comparing in the computer each current measurement with a preceding current measurement on the same conductor and determining the difference in current, and d. means for conveying an electric signal from the computer to the motor drive means to increase the space a predetermined distance when the difference in current is an increase which exceeds a predetermined limit.

In another embodiment of the invention, the improved method and apparatus of this invention also comprises:

e. means for measuring the current to each conductor to each anode set and conveying the current measurement by electric signal to the computer, f. means for conveying an electric signal from the computer to the motor drive means to decrease the space between the anode set and the cathode by a predetermined distance, and after decreasing the space, g. means for obtaining N current measurements of the current to each conductor to each anode set over a predetermined period, and conveying each current measurement by electric signal to the computer, h. comparing in the computer, each current measurement with a preceding current measurement on the same conductor and determining the difference in current, and i. means for conveying an electrical signal from the computer to the motor drive means to increase the space a predetermined distance when said difference in current is an increase which exceeds a predetermined limit.

The difference in current may be determined on the same conductor between any two successive current measurements or between any current measurement and a preceding current measurement during the same predetermined period or a preceding predetermined period. In addition, the difference in current may be determined between any current measurement for the anode set and an average anode set current based upon the bus current for the entire cell. For example, the average conductor current or bus-bar current, is obtained by measuring the total cell current and dividing the total current by the number of conductors to the cell. If desired, the average conductor current is obtained by obtaining the sum of the individual conductor currents to the cell and dividing this sum by the number of conductors to the cell. The acceptable current to the conductor being examined may be from about 1.1 to about 1.5, and preferably about 1.3 times the average cell current. Similar adjustments in the space are made when the average difference or the square root of the average of the squares of the differences in current measurements on the same conductor exceed predetermined limits.

In another embodiment a standard or set-point voltage coefficient, S, is determined for each anode set and subsequent calculations of the voltage coefficient are made and compared with the standard S. When the difference between the calculated voltage coefficient exceeds a predetermined limit above the standard voltage coefficient, S, the space is decreased a predetermined distance. When the calculated voltage coefficient exceeds a predetermined limit, below the standard S, the space is increased and examination of the anode set is made to determine the cause of the problem.

The method and apparatus of the present invention provides for the adjustment of the anode-cathode spacing for individual anode sets in an electrolytic cell where the optimum anode-cathode spacing may vary for all anode sets in a cell. In addition, the selection of cells and anode sets within a cell for possible adjustment may be made randomly or in order.

The method and apparatus of this invention are particularly useful in controlling commercial electrolytic cells where large numbers of cells are connected in series and each cell contains a plurality of anode sets.

Figure 1:
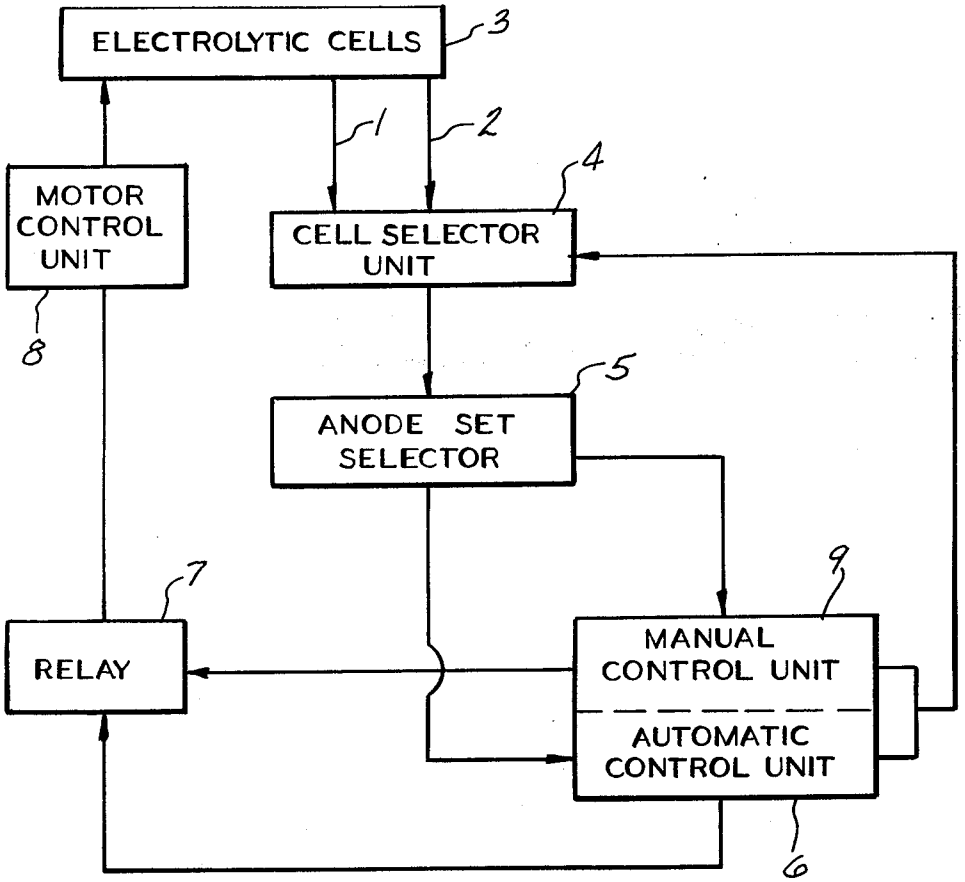
FIG. 1 is a block diagram showing generally the layout of the apparatus of this invention.

FIG. 1 illustrates the apparatus of this invention in block diagram form where electric signals representing current measurements 1 and electric signals representing voltage measurements 2 from each conductor to each anode set (not shown) for each electrolytic cell 3 are selected by cell selector unit 4. Anode set selector unit 5 in response to a signal from manual control unit 9 selects electric signals for current measurements 1 and voltage measurements 2 from any conductor of any desired anode set in electrolytic cell 3 through cell selector unit 4. Automatic control unit 6 transmits signals to cell selector unit 4 to select current measurements 1 and voltage measurements 2 from cell selector unit for desired anode sets and performs the required calculations and comparisons with predetermined limits. When these calculations and comparisons show that raising or lowering of the anode set is necessary, appropriate electric signals are conveyed to relay 7, then to motor control unit 8 which operates upon the anode adjustment mechanism (not shown) to raise or lower the anode set. Motor control unit 8, which can be used for increasing or decreasing the anode-cathode spacing in any anode set in electrolytic cell 3, can also be controlled by manual control unit 9 through anode set selector unit 5.

Figure 2:
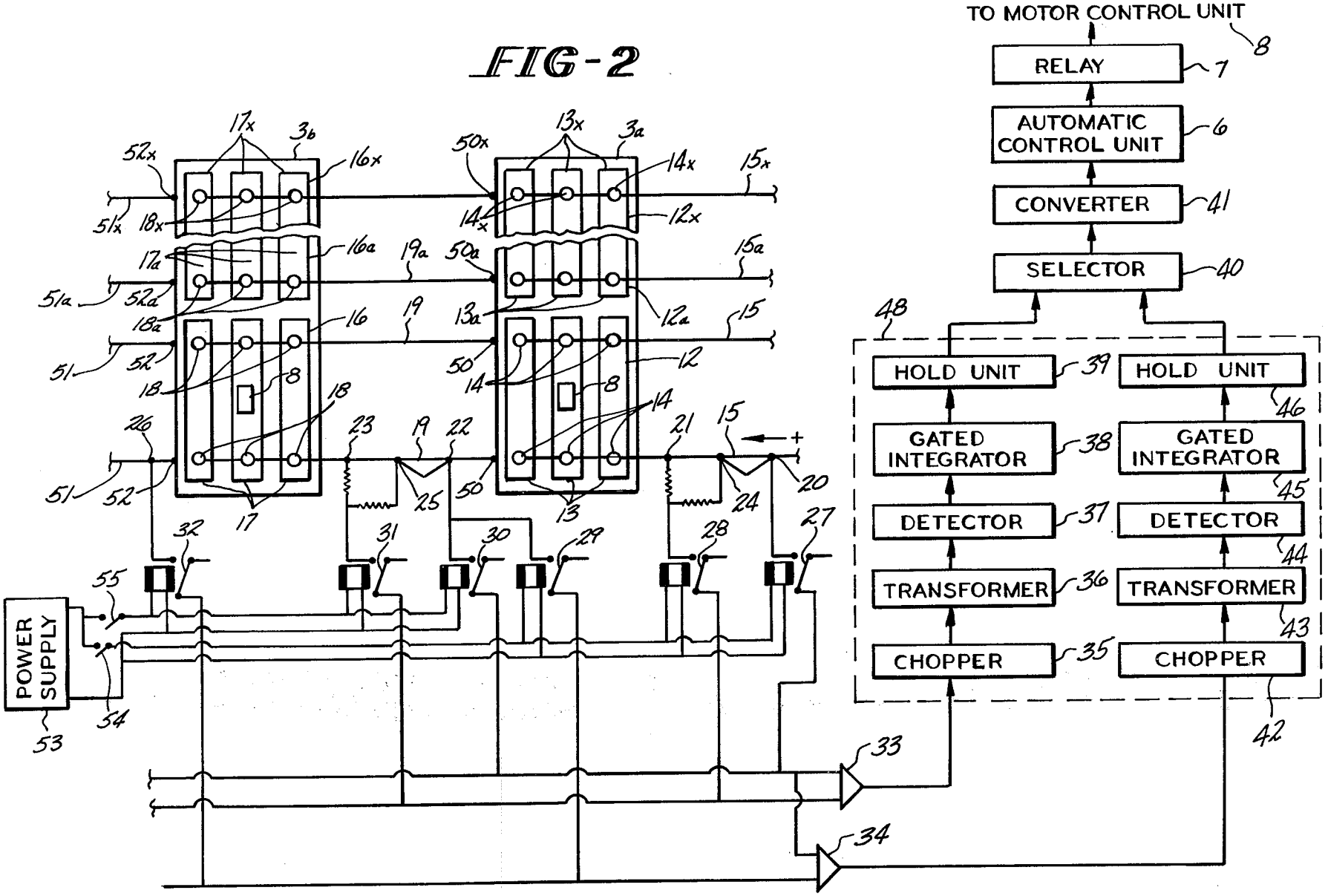
FIG. 2 is a block diagram showing one embodiment of the invention including a signal isolation and signal conditioning system utilizing a transformer.

FIG. 2 is a block diagram showing one embodiment of the signal selection and conditioning system for two adjacent electrolytic cells **3*a* and 3*b***, respectively, in series.

Electrolytic cell **3*a* has a plurality of anode sets 12, 12*a* and 12*x*. Anode set 12 is comprised of at least one anode 13, for example three parallel anodes 13. Each anode 13 is provided with at least one anode post 14, and with two anode posts 14 preferably, as shown, with the anode posts 14 arranged in two parallel rows. A conductor 15 is connected to each row of anode posts 14 in electrolytic cell 3*a*. Current from plant supply (not shown) is conveyed through two conductors 15 to each row of anode posts 14 in anode set 12. Anode sets 12*a* and 12*x* are each comprised of three anodes, 13*a* and 13*x*, respectively, having two rows of anode posts 14*a* and 14*x*, respectively, secured to conductors 15*a* and 15*x***, respectively.

Adjacent electrolytic cell **3*b* has a corresponding number of anode sets 16, 16*a*, and 16*x*. Anode set 16 is comprised of three parallel anodes 17 having two rows of anode posts 18 in each anode set 16. Anode sets 16***a* and 16*x* each have three parallel anodes 17*a* and 17*x* with two rows of anode posts 18*a* and 18*x*.

Current from anode posts 14 of electrolytic cell 3*a* passes to anodes 13, through the electrolyte (not shown), the mercury amalgam (not shown) to the bottom of electrolytic cell 3*a*.

Conductors 19 connect to terminals 50 and 50 at the bottom of electrolytic cell 3*a* at points adjacent to the nearest anode 13 and convey current to the corresponding rows of anode posts 18 in electrolytic cell 3*b*. In a similar manner, current passes from anode post 14*a* and 14*x*, respectively, to anodes 13*a* and 13*x*, respectively, through the electrolyte and the mercury cathode to the bottom of electrolytic cell 3*a*. The cathode terminal is shown symbolically as cathode terminal 50 at the side of electrolytic cell 3*a*, but it is actually positioned on the bottom of the electrolytic cell 3*a*, as is well known in the art, as shown in FIG. 2 of U.S. Pat. No. 3,396,095.

Each conductor 19 conveys current from cathode terminal 50 connected to the bottom of electrolytic cell 3*a* below anode posts 14 to the corresponding row of anode posts 18 in electrolytic cell 3*b*. Conductors 19*a* and 19*x* convey current from other cathode terminals 50*a* and 50*x* below rows of anode posts 14*a* and 14*x*, respectively, to anode posts 18*a* and 18*x*, respectively.

The voltage drop between terminals 20 and 21 on conductor 15 is measured to obtain an electrical signal which is proportional to the current flow to anode set 12. Similarly, the voltage drop between terminals 22 and 23 on conductor 19 is measured to obtain an electric signal which is proportional to the current flow to anode set 16.

The distance between terminals 20 and 21 is the same as the distance between terminals 22 and 23. The current signals from these terminals are altered by thermistor circuits 24 and 25, respectively, where the current signals are temperature compensated. Although FIG. 2 shows thermistor circuit 24 touching conductor 15, it is not in electrical contact with the conductor. Instead, the thermistor circuits are embedded in the bus bar or conductor 15 with an appropriate non-insulating shield. Current signals from thermistor 24 are transmitted across relay circuits 27 and 28 to amplifier 33 and current signals from thermistor 25 are transmitted across relay circuits 30 and 31 to amplifier 33.

The voltage drop across conductor 15 of anode set 12 in electrolytic cell 3*a* is measured between terminal 20 on conductor 15 and terminal 22 on conductor 19, which is the corresponding terminal for the corresponding anode set of the adjacent electrolytic cell 3*b*. Similarly, the voltage drop across conductor 19 in anode set 18 in electrolytic cell 3*b* is measured between terminal 22 on on conductor 19 and terminal 26 on conductor 51, which is the corresponding terminal for the corresponding anode set of the next adjacent electrolytic cell. Thus, the "voltage drop across an anode set", such as anode set 12, is based upon the flow of current from a given point 20 on conductor 15 through anode posts 14 to anodes 13, through the electrolyte, mercury cathode and cathode terminal 50 to terminal 22 on conductor 19. A second voltage drop across anode set 12 is obtained in the same way between the other conductors 15 and 19 communicating with the other row of anode posts 14. These voltage drops for each conductor 15 of anode set 12 are averaged to determined the voltage drop across anode set 12.

Current signals are obtained for the other conductor 15 to anode set 12 as well as all of the other conductors 15*a*, 15*x*, 19, 19*a* and 19*x* in the same manner as described above and as shown in FIG. 2 for conductor 15.

Voltage signals based upon voltage drop across the anode set are obtained for the other row of anode posts 14 of anode set 12 as well as for each of the other rows of anode posts for anode sets 12*a*, 12*x*, 16*a* and 16*x* in the same manner as described above and as shown in FIG. 2.

Current is conveyed from the mercury cathode of electrolytic cell 3*b* through cathode terminals 52, 52*a* and 52*x* positioned beneath rows of anode posts 18, 18*a* and 18*x*, respectively, to conductors 51, 51*a* and 51*x*, respectively.

Thus, for an electrolytic cell containing ten anode sets, each anode set having two rows of anode posts connected to the anodes in the set, there are twenty conductors, each providing through relay circuits 27–32, the first level multiplexing means, a current signal to one of twenty separate amplifiers 33 and a voltage signal to one of twenty separate amplifiers 34.

Relay circuits 27 and 28 are activated through power supply 53 when switch 54 is moved to a closed position. Relay circuits 30 and 31 are also activated through power supply 53 when switch 55 is moved to a closed position.

Temperature compensated current signals are amplified in amplifier 33 and conveyed to chopper 35 in signal isolation and conditioning system 48 where they are converted from direct current signals to alternating current signals. These signals are then transmitted at cell potential to transformer 36 having one terminal of the primary winding connected to cell potential and one terminal of the secondary winding connected to earth potential. The current signals are isolated in transformer 36 and leave at earth potential in order to be compatible with automatic control unit 6. The current signals are transmitted from transformer 36 to detector 37 where the isolated current signals are converted from alternating current signals to direct current signals, and the resulting direct current signals are transmitted to a gated integrator 38 where rejection of electrical noise, particularly that generated by the rectifier which supplies current to electrolytic cells 3*a* and 3*b* is effected. Noise conditioned current signals are transmitted to hold unit 39 (capacitor) and stored until selected by selector 40, the second level multiplexing means.

In a similar manner, the voltage signals are amplified in amplifier 34 and conveyed to a chopper 42, then at cell potential are conveyed to a transformer 43, where the voltage signals are isolated and leave at earth potential. These signals are converted from alternating to direct current in detector 44 and then to gated integrator 45 where rejection of electrical noise is also effected. The resulting voltage signals are transmitted to hold unit 46, (capacitor) where they are stored until selected by selector 40 in the same manner as current signals stored in hold unit 39. In response to a programmed electric signal from automatic control unit 6 (or if desired, an electric signal initiated manually from manual control unit 9 of FIG. 1), current signals and voltage signals from selector 40 for any conductor of any desired anode set such as conductor 15 of anode set 12 or conductor 19 of anode set 16 are selected and transmitted to convertor 41 where they are converted from analog form to binary form and then transmitted to automatic control unit 6 for processing. In automatic control unit 6, the selected signals are compared with predetermined values for the same conductor and anode set, and when necessary, the selected anode set is raised or lowered by an appropriate electric signal from automatic control unit 6 through relay 7 to motor drive 8, which operates to raise or lower the selected anode set.

Generally only one selector 40 is needed as a second level multiplexing means for the entire cell series, but additional selectors 40 may be employed, if desired.

Figure 3:
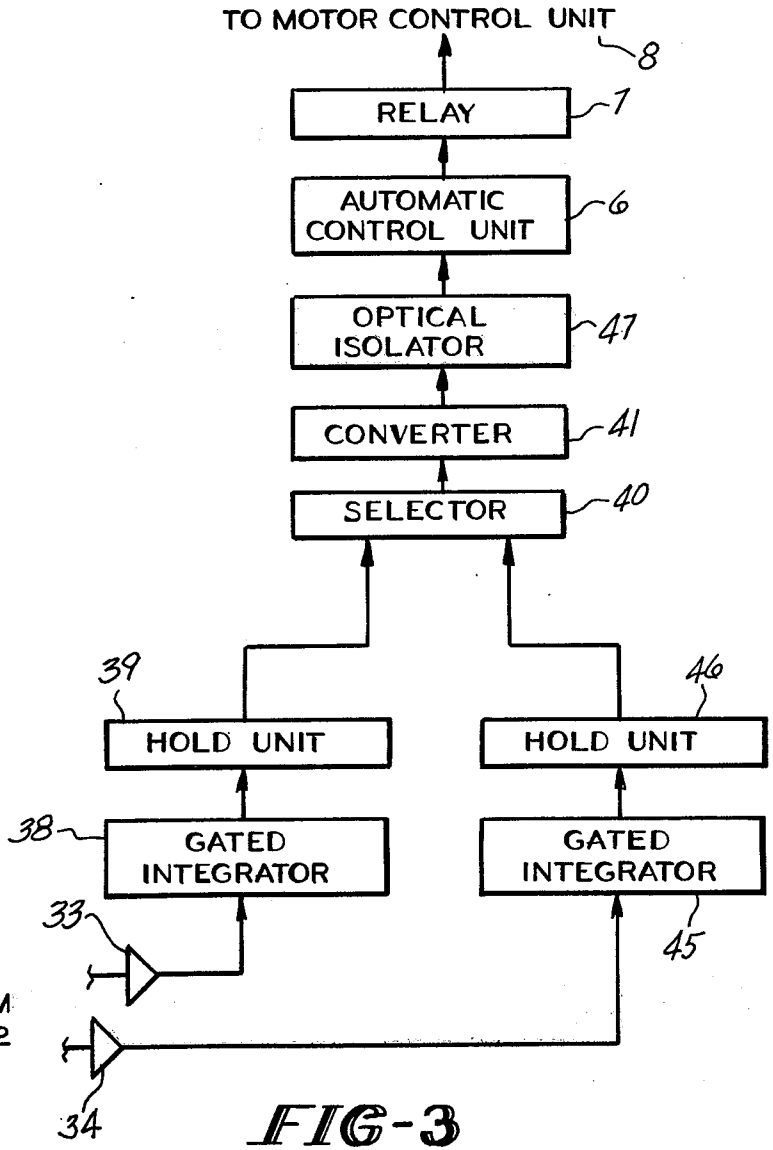
FIG. 3 is a block diagram showing another embodiment of the invention including a signal isolation and signal conditioning system utilizing an optical isolator.

FIG. 3 shows another embodiment of the invention utilizing an optical isolator. In FIG. 3, temperature compensated current signals from amplifier 33 in FIG. 2 are conveyed to gated integrator 38 where rejection of electrical noise, particularly that generated by the rectifier which supplies current to electrolytic cells 3*a* and 3*b*, is effected. Noise conditioned current signals are transmitted to hold unit 39 and stored until selected by selector 40.

In a similar manner, voltage signals from amplifier 34 of FIG. 2 are conveyed in FIG. 3 to a gated integrator 45 where rejection of electrical noise is also effected. The resulting voltage signals are transmitted to hold unit 46, where they are stored until selected by selector 40 in the same manner as current signals stored in hold unit 39. In response to a programmed electric signal from automatic control unit 6, or, if desired, a manually initiated electrical signal, current signals and voltage signals from selector 40 for any desired anode set are selected, the signals are transmitted to converter 41 where they are converted from analog form to binary form and then transmitted to optical isolator 47.

Signals enter optical isolator 47 at cell potential, are isolated and transmitted at earth potential to automatic control unit 6, where the selected signals are compared with predetermined values, and when necessary the selected anode set is raised or lowered in the same manner as described for FIG. 2.

The method and apparatus of the present invention may be used on a variety of electrolytic cell types used for different electrolytes and electrolysis systems. The invention is particularly useful in the electrolysis of alkali metal chlorides to produce chlorine and alkali metal hydroxides. More particularly, the invention is especially suitable for use in combination with the anode adjusting mechanisms driven by an electric motor or the like operating on adjustable anodes positioned in horizontal electrolytic cells having a liquid metal cathode such as mercury, as disclosed, for example in U.S. Pat. Nos. 3,390,070 and 3,574,073, which are hereby incorporated by reference in their entirety.

As indicated in U.S. Pat. No. 3,574,073, issued Apr. 6, 1971, to Richard W. Ralston, Jr., horizontal mercury cells usually consist of a covered elongated trough sloping slightly towards one end. The cathode is a flowing layer of mercury which is inroduced at the higher end of the cell and flows along the bottom of the cell toward the lower end. The anodes are generally composed of slotted rectangular blocks of graphite or metal distributors having an anodic surface comprised of titanium rods or mesh coated with a metal oxide secured to the bottom of the distributor. Anode sets of different materials of construction may be employed in the same cell, if desired. The anodes are suspended from at least one anode post such as a graphite rod or a protected copper tube or rod. Generally, each rectangular anode has two anode posts, but only one, or more than two, may be used, if desired. The anodes in each anode set are placed parallel to each other, the anode posts forming parallel rows across the cell. The bottoms of the anodes are spaced a short distance above the flowing mercury cathode. The electrolyte, which is usually salt brine, flows above the mercury cathode and also contacts the anode. Each anode post in one row of an anode set is secured to a first conductor, and the other row of anode posts is secured to a second conductor. Each conductor is adjustably secured at each end to a supporting post secured to the top of the cell. Each supporting post is provided with a drive means such as a sprocket which is driven through a belt or chain or directly by a motor such as an electric motor, hydraulic motor or other motor capable of responding to electric signals from automatic signal device 6.

Although the invention is particularly useful in the operation of horizontal mercury cells used in the electrolysis of brine, it is generally useful for any liquid cathode type electrolytic cell where adjustment of the anode-cathode space is necessary for efficient operation.

The number of electrolytic cells controlled by the method and apparatus of this invention is not critical. Although a single electrolytic cell can be controlled, commercial operations containing more than 100 cells can be successfully controlled.

Each electrolytic cell may contain a single anode, but is preferred to apply the method and apparatus of this invention to electrolytic cells containing a multiplicity of anodes. Thus the number of anodes per cell may range from 1 to about 200 anodes, preferably from about 2 to about 100 anodes.

It is preferred, particularly on a commercial scale to adjust anode sets when adjusting the space between the anodes and cathode of electrolytic cells. An anode set may contain a single anode, but it is preferred to include from 2 to about 20 anodes, and preferably from about 3 to about 12 anodes per anode set. Voltage and current meaurements are obtained for each conductor for each row of anode posts of each anode set in each cell.

When each anode set, such as anode set 12, is initially connected in an electrolytic cell 3*a*, which is operated by the method and apparatus of this invention, anode set 12 is lowered to a point where the bottoms of anodes 13 are about 3 millimeters above the mercury cathode. In addition, a set point for the standard voltage coefficient, S, for each conductor 15 is entered into the program of automatic control unit 6. This set point voltage coefficient and subsequent measurements of voltage coefficients, Vc, are calculated according to the formula:

$$Vc = V - D/KA/M^2$$

where V is the measured voltage across an anode set, D is the decomposition voltage for the electrolysis being conducted, and $KA/M^2$ is the current density in kiloamperes per square meter of cathode surface below each anode set. In the electrolysis of sodium chloride in a mercury cell for producing chlorine, the value for D is about 3.1.

Standard or set-point voltage efficient, S, may vary with a number of factors such as the material of construction of the anode (graphite or metal), the form and condition of the anodes (blocks of graphite which are slotted or drilled, metal mesh or rods coated with a noble metal or oxide) and the location of the anode set in the cell, among other factors. As indicated in "Intensification of Electrolysis in Chlorine Baths with a Mercury Cathode", *The Soviet Chemical Industry,* No. 11, November, 1970, pp. 69–70, the standard voltage coefficient (K or S) was found to vary as follows:

| K, standard voltage coefficient, V/kA | Condition |
|---|---|
| 0.55 | no device for regulating anode position |
| 0.3 | use of device for lowering anode |
| 0.2 | intensive perforation of the anodes |
| 0.14 | increased perforation of the anodes |
| 0.09 | use of titanium anodes with ruthenium dioxide coating |
| 0.022 | anodes specially placed in the amalgam |

When the anode set is comprised of metal anodes having a titanium distributor with an anodic surface formed of small parallel spaced-apart titanium rods coated with an oxide of a platinum metal secured to the bottom of the distributor, a standard voltage coefficient ranging from about 0.09 to about 0.13 is entered as the set-point into the program of automatic control unit 6. A deviation, k, which is the permissable range of deviation from S, is also entered into the program. Generally, k varies from about 0.1 to about 10, and preferably from about 2 to about 8 percent of S.

After positioning anode set 12 as described above and entering the values for S and k into the program anode set 12 is lowered a small predetermined distance, from about 0.05 to about 0.5, and preferably from about 0.15 to about 0.35 mm. Then two electrical signals are generated and measured for each conductor 15 of anode set 12. One electric signal corresponds to the current flow in conductor 15 for anode set 12, and may be obtained by measuring the voltage drop between a plurality of terminals, preferably two (20 and 21) spaced a suitable distance apart along the conductor. The spacing between terminals may vary from about 3 to about 100 inches, but a space of about 30 inches is generally used. The space between terminals should be the same distance for all conductors. It is desirable that the terminals be located laterally in the middle of the conductor, in a straight segment of conductor of uniform dimensions. This straight segment of conductor serves as a shunt to provide a signal for the measurement of current through the conductor. Current measurements may also be obtained using other well known methods such as by the Hall effect or other magnetic detection devices.

The current signal is compensated for temperature changes in the conductor by thermal resistor 24 and other thermal resistors of the system which are coated with glass or other insulating material and then embedded or otherwise attached to the section of conductor or bus bar being used as the source of the current signal.

The other electric signal is the voltage drop which is measured between corresponding terminals across the anode set. When a multiplicity of cells are controlled by the method and apparatus of this invention, the terminals are on the conductors for the corresponding anode sets of two adjacent cells, such as terminal 20 on conductor 15 and terminal 22 on conductor 19.

The current signals and the voltage signals for each conductor 15 to anode set 12 are transmitted to automatic control unit 6 as described above in the discussion of FIG. 2. It is preferred to obtain the average of a series of N current measurements and the average of a series of N voltage measurements for each conductor 15 for a predetermined period. For example, automatic control unit 6 is programmed to obtain current measurements and voltage measurements at the rate of from about 10 to about 120, and preferably from about 20 to 60 measurements per second. These measurements are obtained for a period of time ranging from about 1 to about 10, and preferably from about 2 to about 5 seconds. The maximum difference in the current measurements in the series at this position i.e., a gap of at least about 3 mm between the anode and cathode, is determined and utilized as described below in the second current analysis. The average current measurement and average voltage measurement is obtained in the computer for each series of measurements for each conductor 15. The average total current measurement for anode set 12 is obtained from the sum of the average currents to each conductor. The average voltage measurement is obtained for each anode set 12 by averaging the average voltage measurements for each conductor 15. These average values are then used by automatic control unit 6 to calculate the voltage coefficient for anode set 12 in accordance with the above formula for Vc.

In making the calculation for Vc for each anode set, the area of cathode surface below each anode set may be obtained by utilizing the individual conductor voltages and measuring the area of each anode set. If desired, the current density, $KA/M^2$ may be calculated by assuming that the current in one conductor 15 passes through half of the anode set area and current in the other conductor passes through the other half of the anode set. A formula utilized for Vc in an anode set having conductor 1 and conductor 2 is as follows:

$$Vc = \frac{\left(\frac{V_1 + V_2}{2}\right) - D}{\frac{KA_1 + KA_2}{M^2}}$$

where $V_1$ is the average voltage drop in volts across conductor 1.

$V_2$ is the average voltage drop in volts across conductor 2.

$KA_1$ is the average current in kiloamperes through conductor 1 through the cathode to the respective cathode compartment.

$KA_2$ is the average current in kiloamperes through conductor 2 through the cathode to the respective cathode compartment.

$M^2$ is the area of the cathode under the anode set, in square meters.

When the anode set 12 is initially installed it is generally positioned with a large gap, (about 3 mm. or more) between the bottom of the anodes and the cathode. As a result, the first measured voltage coefficient Vc usually exceeds S by more than deviation k. After this comparison is completed, an electrical signal is transmitted from automatic control unit 6 to motor drive unit 8 to lower anode set 12 a small distance within the ranges described above.

A new voltage coefficient, Vc, is calculated for the new position of the anode set by the same procedure and the resulting voltage coefficient is compared with S. If the new voltage coefficient, Vc exceeds S by more than deviation, k, the adjustment procedure is repeated until an anode set position is obtained where voltage coefficient Vc does not vary from S by more than the value of deviation k. After anode set 12 is in a position where the voltage coefficient falls within the deviation k of value S, the current measurements of conductor 15 for anode set 12 are also analyzed to determine whether the anode is too close to the cathode.

Following each decrease in the anode-cathode spacing, a series of N current measurements for each conductor 15 to anode set 12 are taken for a predetermined period within the above defined ranges. Each current measurement is compared with the preceding current measurement to determine the amount of current increase, and where the current increase exceeds one of several predetermined limits the anode-cathode spacing is immediately increased a predetermined distance. In the first analysis, if the increase in current between the current measurements made immediately before and immediately after the decrease in anode-cathode spacing is greater than a predetermined limit, the anode-cathode spacing is immediately increased. For example, if the anode set is lowered a distance within the above-defined ranges, for example about 0.3 mm, and an increase in current on either conductor 15 in excess of a predetermined limit occurs, for example, an increase of more than about 5 percent above the previous current measurement, automatic control unit 6 is programmed to transmit an electric signal to motor drive means 8 to cause the anode-cathode spacing to be immediately increased a distance within the above-defined ranges. If the decrease in anode-cathode spacing is smaller than 0.3 mm, a proportionately smaller increase in current differences is used as a limit to effect raising of the anodes.

In a second current analysis, if anode set 12 has not been raised in the first current analysis, a series of N current measurements are taken for each conductors 15 for a predetermined period in the ranges described above to determine the magnitude of current fluctuations. The second current analysis is made based upon the average magnitude of the current fluctuations or differences as determined by any convenient method prior to comparing with a predetermined average difference limit. This average difference limit is determined, for example, by doubling the average difference in the current measurements made in the series N for each conductor 15 when the anode set was initially installed at a large gap between the anode and cathode of at least about 3 mm. The average difference in current in the series of measurements obtained at the initial position generally ranges from about 0.2 to about 0.4 percent of the current to each conductor the anode set in that series and thus the predetermined limit for average current difference in a series N ranges from about 0.4 to about 1.6 percent. The term "average difference" when used in the description and claims to define the magnitude of the current fluctuations is intended to include any known method of averaging differences. For example, in a preferred embodiment a calculation is made $\Sigma\Delta 2/N$, where $\Delta$ is the difference in current between each successive reading in the series and N is the total number of current measurements taken. If this average difference is greater than the predetermined average difference limit, the anode-cathode spacing is immediately increased a predetermined distance. As an alternate, the average difference may be obtained by the calculation $$\frac{\sqrt{\Sigma\Delta^2}}{N}$$

or any other similar statistical technique.

A third current analysis determined from the series N of current measurements is whether the current continues to increase for each measurement during series N during a predetermined time period described above. If the current continues to increase for each measurement, the anode-cathode spacing is immediately increased, for example, to the previous position. The number of measurements and the predetermined time period used in this analysis are within the ranges described above, but are more preferably about 180 measurements in four seconds.

The fourth analysis of the current measurements determines whether an increase in current for any two measurements during series N, is greater than a predetermined limit, for example, an increase of about 6–8 percent. If so, the anode-cathode spacing is immediately increased by an appropriate electric signal from automatic control unit 6 to motor drive unit 8.

A fifth current analysis compares each current measurement in the series with the previous current measurement, and if the difference between two successive current measurements exceeds a predetermined limit, the distance between the anode and cathode is increased by transmitting an appropriate electrical signal from automatic control unit 6 to motor drive unit 8. When one current measurement is exceeded by the next successive current measurement in an amount from about 0.5 to about 3 percent, and preferably from about 1 to about 1.5 percent of the prior current measurement, the distance between the anode and cathode is increased as described above.

In a sixth current analysis, particularly in a simultaneous scan of all conductors, if any current measurement of a conductor exceeds the average bus current or average conductor current for the entire electrolytic cell by a difference ranging from about 10 to about 50 percent, and preferably from about 20 to about 40 percent of the average cell current for the entire electrolytic cell, then the anode set to which this conductor supples current is raised a predetermined distance.

In more detail, in a method of conducting electrolysis in an electrolytic cell circuit having a plurality of electrolytic cells, each of said cells having a flowing mercury amalgam cathode and a plurality of anode rows in a plurality of vertically movable anode banks, and a current flow from the anodes in said anode banks to the cathode, and having a common control element the improvement comprising:

a. discretely measuring each of the individual current flows through the anode rows of a single cell at intervals sufficient to detect and respond to incipient changes therein, b. electrically generating individual first electrical signals proportional to the individual current flows in each of the individual anode rows;

c. simultaneously transmitting all of the said first electrical signals from a single cell to and through a first level of switches, or first level multiplexing means, to a second level of switches, or second level multiplexing means, d. individually transmitting each of said first electrical signals from said second level of switches to the common control element;

e. electrically generating a second electrical signal proportional to the average of the individual current flows through said anode rows; and f. electrically generating individual anode row error signals proportional to the difference between said individual first electrical signals and said second electrical signal whereby to control said cell whereby to maintain the individual current flows within a preset range of the average of the individual current flows through the anode rows of said cell.

Although it is possible to compare conductor current with average conductor current based upon the total cell current, it is preferred to compare conductor current with a prior current reading for the same conductor. When two or more conductors feed a single anode set, there may be a small amount of current crossing from one end of an anode in the set to the other end of the anode in the same set due to changes in anode characteristics. However, the bulk of the current, generally at least about 90% of the current, travels directly to the electrolyte for decomposition, through the liquid cathode to the cell bottom. At the cell bottom, the current is redistributed to the conductors carrying current to the next cell. Each of these conductors will generally have a different current from the corresponding conductor on the preceeding cell, even though the total current to each cell is equal. Measuring the change of current in the conductor based upon prior current meaurements for the same conductor in accordance with this invention gives a more realistic basis for adjusting the anode than previously known techniques.

Under unusual circumstances, the current measurement of one conductor may indicate a need to lower the anode set while the measurement for another conductor to the same anode set may indicate a need ro raise the anode set. In this situation, the anode set is raised. As indicated below, when the frequency of change of anode-cathode spacing exceeds a predetermined limit, the anode set is raised and removed from automatic control.

If any of the current analyses require raising of the anode set a predetermined distance, a new series of current and voltage measurements are obtained and a new voltage coefficient, Vc, is calculated. If the calculated voltage coefficient is below S by more than deviation, k, an electrical signal is transmitted from automatic control unit 6 to motor drive unit 8 to raise anode set 12 a small distance within the ranges described above. If the calculated voltage coefficient is above S by more than deviation k, the anode set is lowered a predetermined distance. If the new voltage coefficient is within the limits k, then the current analyses are repeated.

After a position is found for anode set 12 where the voltage coefficient is within the above-defined predetermined range and none of the above defined current analysis requires raising anode set 12, it may be retained in this position until subsequent automatic scanning, which is defined more fully below, shows the need for further movement of the anode.

All anode sets in a selected cell may be simultaneously adjusted using the above method. The method of the second current analysis can also be employed to locate in a series of adjacent cells, the cell having the highest amount of current fluctuation.

In a further embodiment of the method of the present invention, all anode sets for all cells in operation are serially scanned periodically by the automatic control unit 6 and the current and voltage readings for each anode set compared with their predetermined value ranges. Where the current reading exceeds the above defined predetermined limits, the anode-cathode spacing is increased. This periodic scan detects current overloads to any anode set on a continuing basis. The automatic control unit requires about three seconds to scan the current and voltage measurements for a group of 58 cells containing about 580 anode sets. Any suitable interval between scans may be selected, for example, intervals of about one minute. If during a scan, the anode-cathode spacing for an anode set is increased, the scan is repeated for all anode sets for all operative cells.

A further embodiment of the method of the present invention comprises counting the frequency of change in the anode-cathode spacing for a particular anode set during a predetermined time period and where this frequency exceeds a predetermined number, raising the anode set to remove it from automatic control. For example, if the anode-cathode spacing for any anode set in the system is adjusted from about 20 to about 80, and preferably from about 50 to about 70 times over a 24-hour period, the anode set is raised and removed from automatic control. When this predetermined number of adjustments is exceeded, an appropriate signal such as sounding of an alarm, activating a light on a control panel or causing a message to be printed out on a reader-printer unit associated with a computer is effected, in order that the operator will examine the set to determine what the problem is and correct it.

If the current analyses indicates that the distance between the anode and cathode must be increased at several successive positions, the anode set is raised to the original starting position and a new standard voltage coefficient, S, is placed in the program of the automatic control unit 6. The new standard voltage coefficient, S is increased a predetermined amount above the initial standard voltage coefficient S. Generally the increase is from about 5 to about 20, and preferably from about 10 to about 15 percent of the initial standard voltage coefficient. The above defined procedure for positioning the anode set based upon voltage coefficient is then repeated until a position is found where the voltage coefficient is within the above defined predetermined range.

Automatic control unit 6, when scanning shows voltage coefficient and current measurements to be outside predetermined limits, may also provide appropriate electric signals to motor drive unit 8, to lower anode set 12 a predetermined distance, r, obtain another set of measurements of current and voltage coefficient and continue lowering anode set incrementally a predetermined distance until the voltage coefficient or current analyses indicates that the anode set should be raised a predetermined distance, r. Automatic control unit 6 then provides signals to lower anode set 12 a fraction of r, for example ½r, and a new set of measurements are obtained. If measurements do not require moving anode set 12 from this position, it is retained here until subsequent scanning shows the need for further adjustment.

A typical program for operating the apparatus of this invention is described in FIGS. 4–9 for a cell system comprised of 58 mercury cells in series. Each cell operates at a current of about 150,000 KA and a voltage of about 4 volts. Each cell contains 10 anode sets, and each anode set consists of five anodes. Each anode is provided with two anode posts which are connected by means of two conductors or bus bars in parallel with the corresponding anode posts of the adjacent anode. Each anode set is provided with an electric motor driven, sprocket operated adjusting device of the type described in U.S. Pat. No. 3,574,073 which issued Apr. 6, 1971 to Richard W. Ralston, Jr. The electric motor drive for each anode set and each bus bar are connected electrically, as shown in FIGS. 1–3 to automatic control unit 6. Automatic control unit 6 is a digital computer provided with a program of the type shown in FIGS. 4–9 to adjust the gap between the anodes of each anode set and the mercury cathode during electrolysis of salt brine in the cells.

Figure 4:
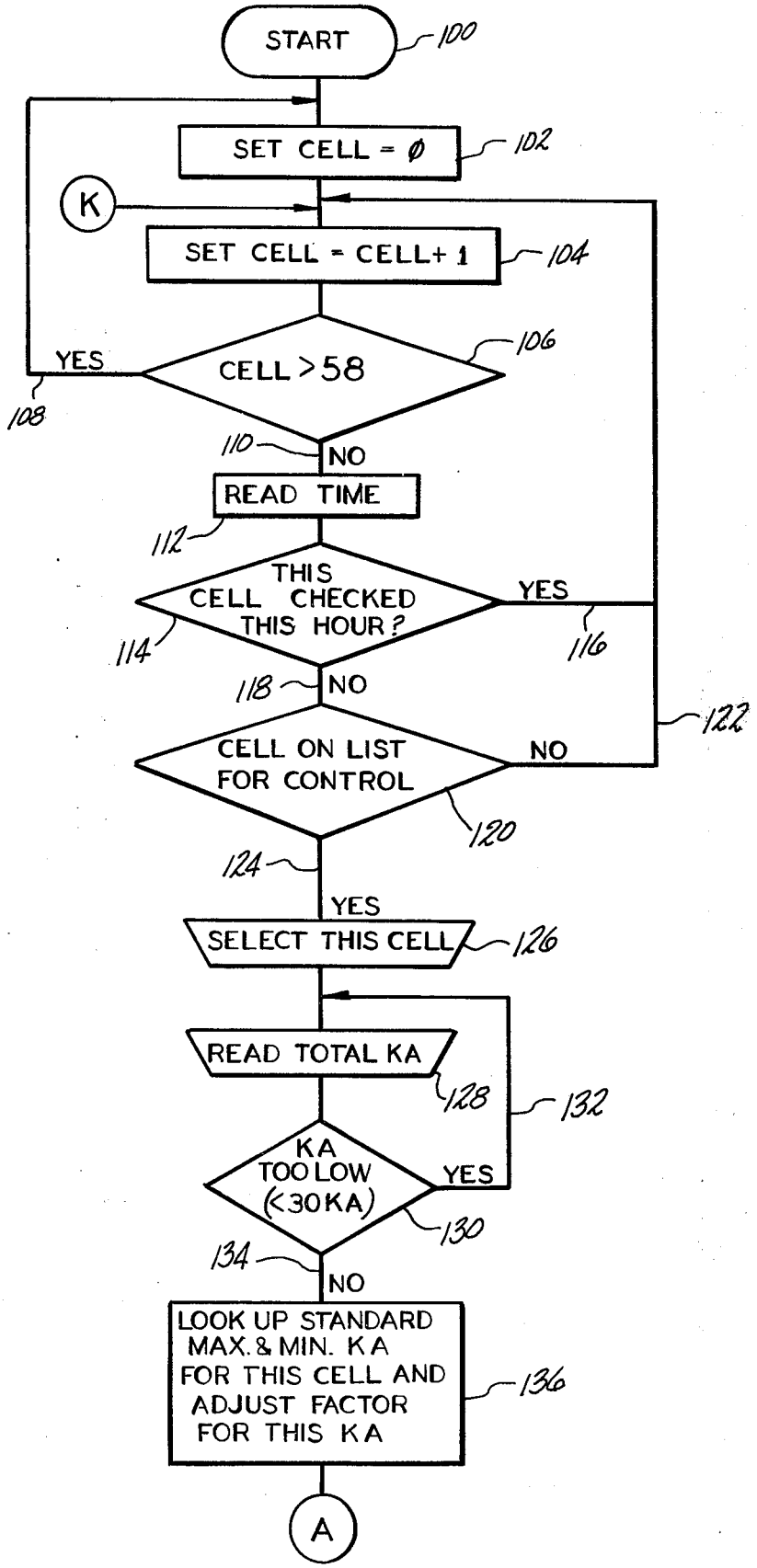
FIGS. 4–9 show a typical program flow sheet.
Figure 5:
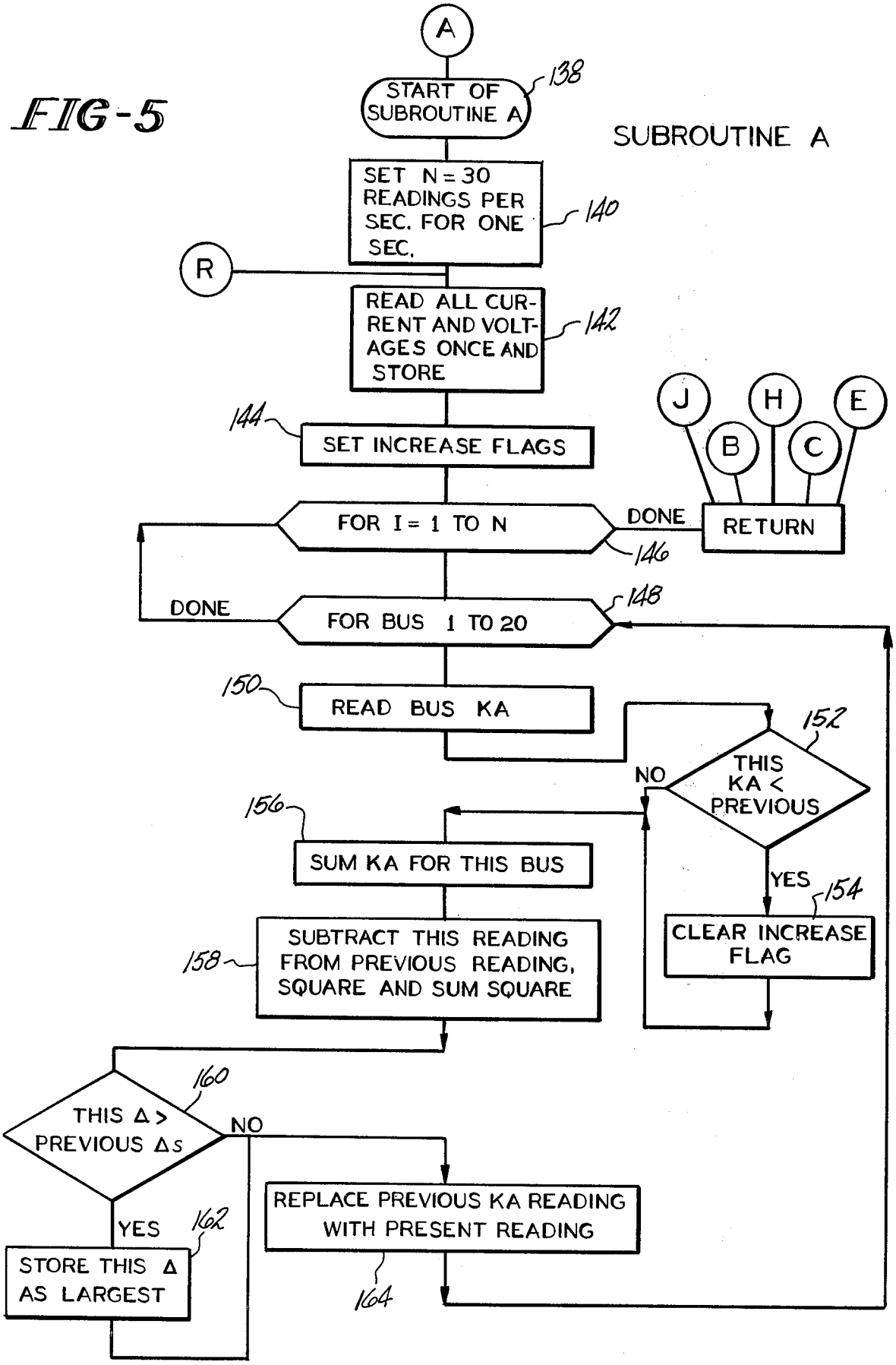

Referring to FIG. 4, beginning with start 100 the program proceeds to processing step 102 where the "cell" variable is set equal to zero. In the next step 104, the program adds "1" to the "cell" number and then tests in decision step 106 the resulting number to determine if it is greater than the number of cells in the plant (58 cells). If the cell number determined in decision step 106 exceeds 58, the program returns by path 108 to start 100. If the cell number does not exceed 58 in decision step 106, the program follows path 110 to time clock 112 where the time is read, recorded, and then checked with the prior time of adjustment of anodes for the specific cell number. In decision step 114 a determination is made whether an adjustment has been effected within the past hour. If the selected cell has been adjusted within the past hour, the program follows path 116 to step 104 where the next cell is selected. If it is determined in determination step 114 that the selected cell has not been adjusted within the past hour, the program follows path 118 to decision step 120 to determine if the selected cell is on the list of cells to be controlled by the program. If the cell is not on the list to be controlled, the program follows path 122 to step 104 where the next cell is selected. If the cell is on the list of cells to be controlled, the program follows path 124 to step 126.

In step 126, the selected cell is then evaluated by obtaining current signals for each bus bar or conductor (a total of 20) entering the selected cell. As shown in FIG. 2, these signals are attained by operating relays 27, 28, and 29 for conductor 15 of cell 3*a* of FIG. 2 and the relays for the corresponding conductors 15*a*–15*x* entering the entire cell. Each of these current signals are conveyed to selector 40 as shown in FIG. 2. In step 128, the total cell current is read for the selected cell as determined, for example, by a Halmar totalizing ammeter, which measures flux in the combined plant bus bar (conductor) system. The program proceeds to decision step 130 where the total measured cell current value is compared with a predetermined value for cell current, which in this case is 30 kiloamps.

If the total current is below the pre-determined value, the program follows path 132 and returns for another reading of the total current. No anode adjustment is made until the operator increases the cell current above the pre-determined value. If the total cell current exceeds the pre-determined value, the program follows path 134 to process step 136 where the maximum and minimum current values for this cell are read from the pre-determined stored portions of the program. An adjustment factor is applied to the current reading obtained in step 136. The program then proceeds to start 138 of sub-routine A in FIG. 5. In the first step 140, the number of times for reading each signal per second is set at 30 for a period of one second. The program then proceeds to step 142 where all current signals and voltage signals in each bus bar of the selected cell are read and stored as a set of previous readings. In step 144 flags are set in the program to show a continuous increase of any signal reading for each bus bar.

The program proceeds to process step 146 where one reading is selected in a set of N readings, and the selection is conveyed to process step 148, where a specific bus bar is selected. The selection of reading and bus bar are conveyed to process step 150, where the current signal for the selected bus bar is obatined. This current signal is compared to the prior current signal in decision step 152. If a decrease occurs, the appropriate increase flag in step 144 is cleared in step 154. The current reading, whether it is an increase or decrease, is added to the sum of prior readings for this bus bar in step 156. In addition, this same reading is substracted from the previous current signal reading, the current difference is squared, and this product is added to the sum of the squares for this particular bus bar in step 158.

In step 160, the difference between current readings is compared with the largest prior difference previously determined. If the difference is larger than any other, it is stored as the largest current difference. The present current reading then replaces in step 164 the prior current reading, and the program returns to step 148. After each bus bar current has been analyzed the program returns to step 146 to complete all readings in the series for each bus bar, and when completed, the program leaves the sub-routine and returns to the program at point B on FIG. 6.

The program proceeds on path 166 to decision step 168 where the prior voltage reading for the entire cell is compared with the value of three volts. If the voltage is less than three volts, the program proceeds on path 170 to step K on FIG. 4, since such a voltage measurement indicates that the cell is out of service. Step 104 then proceeds to analyze the next cell in series. If the voltage is greater than three volts, the program follows path 172 to decision step 174 where the voltage and current measurements for each bus bar are used to calculate the voltage coefficient which is then compared with a previously determined standard voltage coefficient range for the selected bus bar. If the calculated voltage coefficient exceeds the standard range, the program follows path 176 to step 178, where all anodes are lowered by a pre-selected distance through, for example, 0.5mm, by sending an appropriate signal to motor control unit 8. If the calculated voltage co-efficient is below the standard coefficient range, the program follows path 180 to step 182 which sends an appropriate signal to motor control unit 8 of FIG. 2 to raise all anodes in the cell by a pre-determined distance, for example by 0.5 mm. If the calculated voltage coefficient is within the standard coefficient range, the program then proceeds along path 184 to the sub-routine A of FIG. 5. Similarly, after adjustment has been made in step 178 or step 182, the program proceeds to sub-routine A of FIG. 5. In each of these three alternates, after the sub-routine A has been completed, the program returns to point C of FIG. 6 and then proceeds to process step 186 which selects current measurements for each pair of conductors in each of the ten anode sets for the cell selected in process step 174. For a selected anode set having conductors A and B (or bus A and bus B) the program proceeds on path 188 to selection step 190 which selects the current signal for bus A and compares it with a standard pre-determined maximum current for this bus bar.

Depending upon the position and the past history of the anode sets in the cell, a separate current standard is established for each anode set. For example, at start-up with new metal electrodes in a cell utilizing 150,000 kiloamps, it is assumed that each of the ten anode sets will average about 15,000 kiloamps per set, the average being adjusted for the first and last sets in the series. The first and last sets have a range which is about 95 percent of the average, ± 4 percent. For the intermediate eight sets, the current range is about 102 percent of the average cell current ± 4 percent. As the cell is utilized, these ranges are modified as discussed above.

If the current for bus A, as determined in step 190, exceeds the maximum for this selected bus bar, the program follows path 192 to process step 194 where a signal is sent to motor control unit 8 to raise the anodes a pre-determined distance, for example about 1 mm. The program then follows path 196 to return to selection step 186 for analysis of additional anode sets in the cell. If the analysis of current in step 190 shows that the current for bus A is less than the standard maximum, the program follows path 198 to process step 200 where the current signal for companion bus bar B is compared with the standard maximum. If the current signal for bus bar B exceeds the standard maximum, the program follows path 202 to step 194 where an appropriate signal is sent to motor control unit 8 for raising the anode set by about 1 mm.

If the current signals of bus bar A and bus bar B are both below the standard maximum, the program follows path 204 to decision step 206 where the current of bus bar A is compared with the standard minimum. If the current is not below the minimum standard, the program follows path 208 to selector step 210 where the current of companion bus bar B is compared with the standard minimum for that specific anode set. If the current for bus bar A as determined by step 206 and for bus bar B as determined by step 210 are each within the standard range, the program proceeds along path 212 to anode set selector 186 for further processing.

If the current signal for either bus bar A or bus bar B are below the standard minimum, the program then proceeds to point D on FIG. 7 along path 214 or 216 to step 218 where a signal is conveyed to motor control unit 8 to lower the anodes in the set by 1 mm. After lowering, the program then returns by path 220 to sub-routine A in FIG. 5. After completion of sub-routine A, the program returns to point E in FIG. 7. The program then follows path 224 to step 226. In this step, the program examines the stored changes of position of the anode set and if it is determined that the number of changes has exceeded a pre-determined limit, a signal is sent by path 228 to step 230 to raise the anode set the distance of 1 mm. The program then follows path 232 to the main program at 246. If there has not been any excessive changing of the position of the anode set, as determined in step 226, the program then follows path 236 to step 238 where the remaining increase flags are detected. If there are no remaining increase flags detected, the program follows path 240 to point F which is located on FIG. 6. If any increase flags are detected in step 238, the program proceeds along path 242 to step 244, where a signal is sent to raise the identified anode set by a pre-determined distance, for example about 0.5 mm. After raising the anode, the program follows path 246 to step 248 where "one" is added to the count of moves for this anode. The program then proceeds to point F in FIG. 6.

Figure 6:
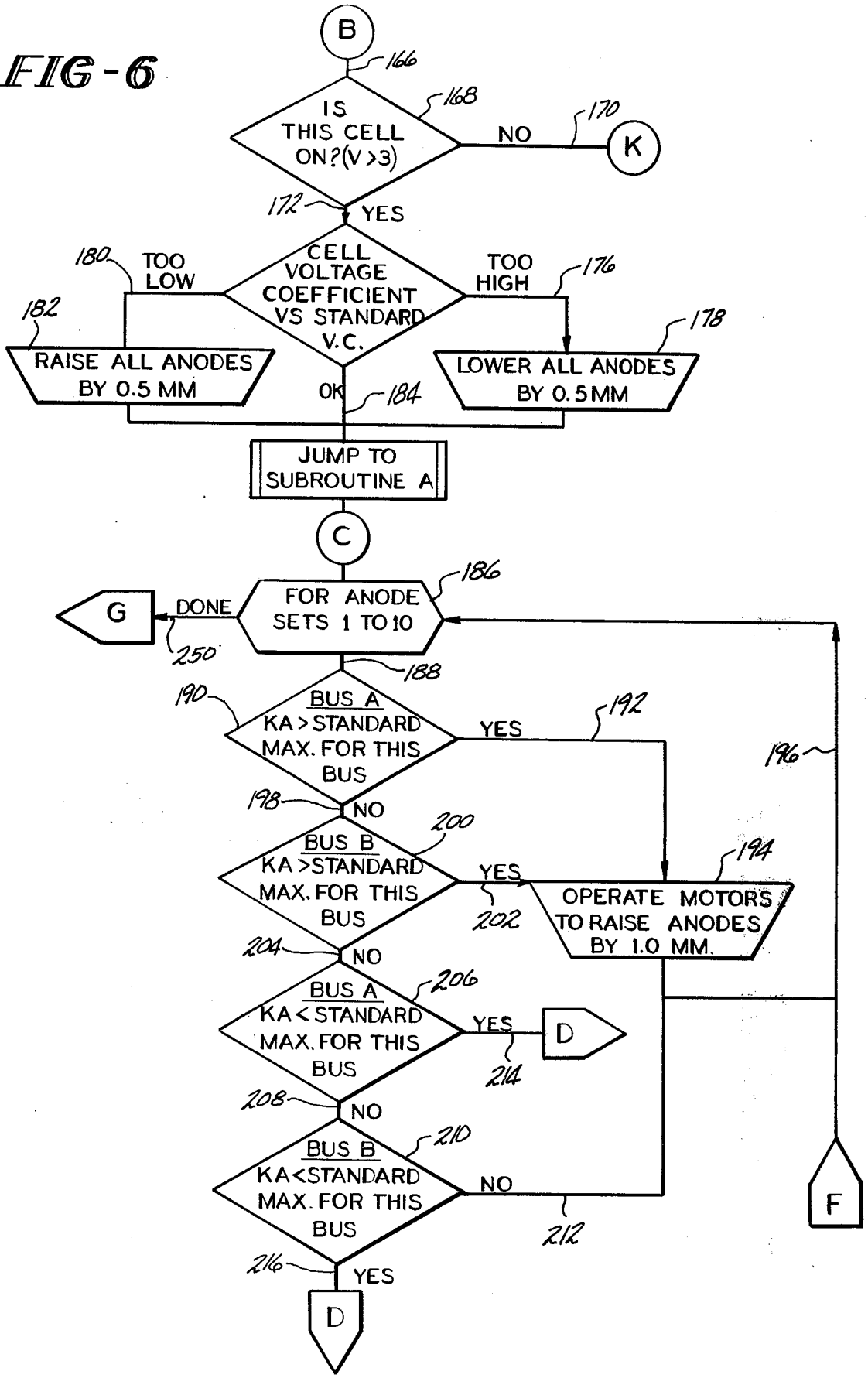
Figure 7:
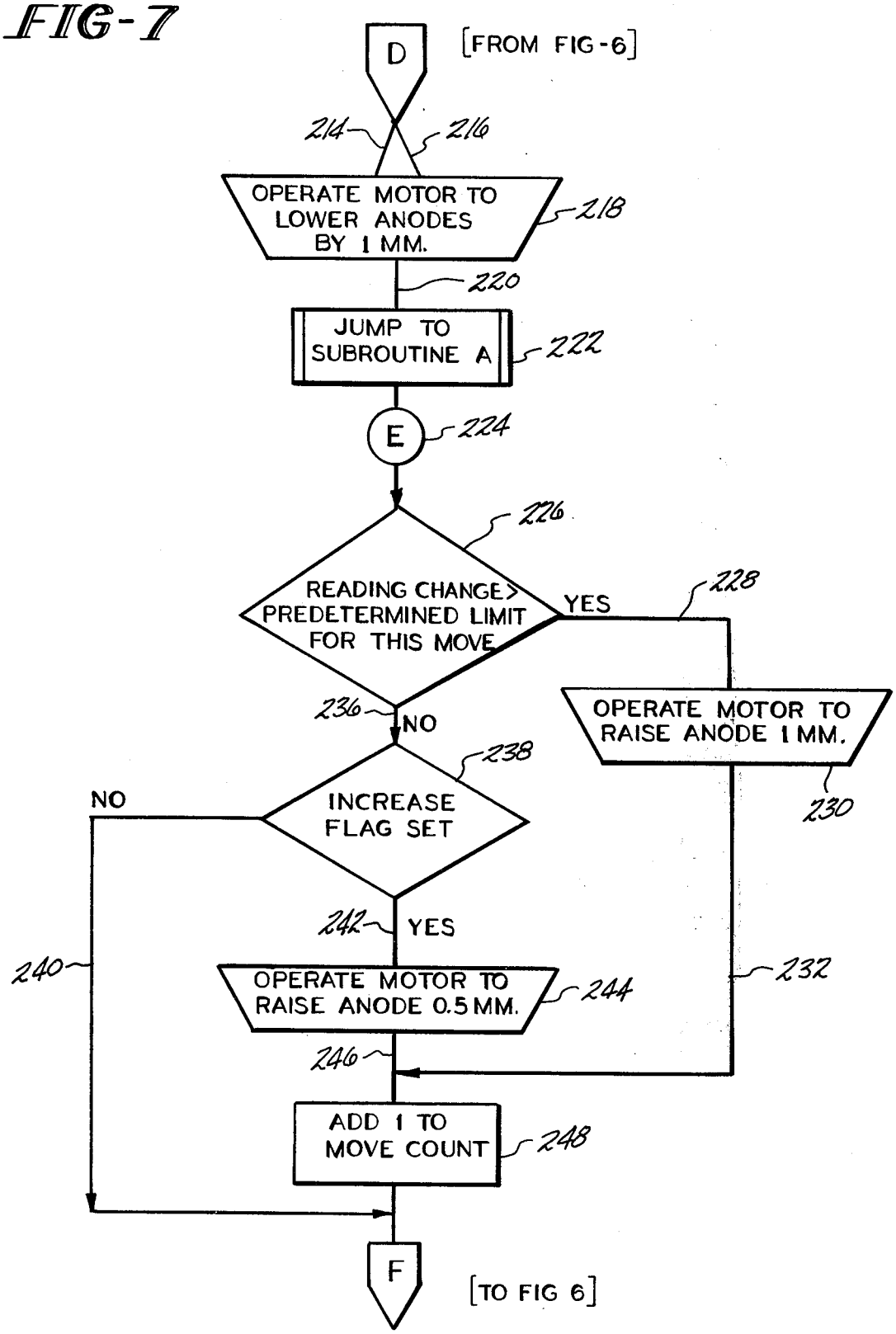
Figure 8:
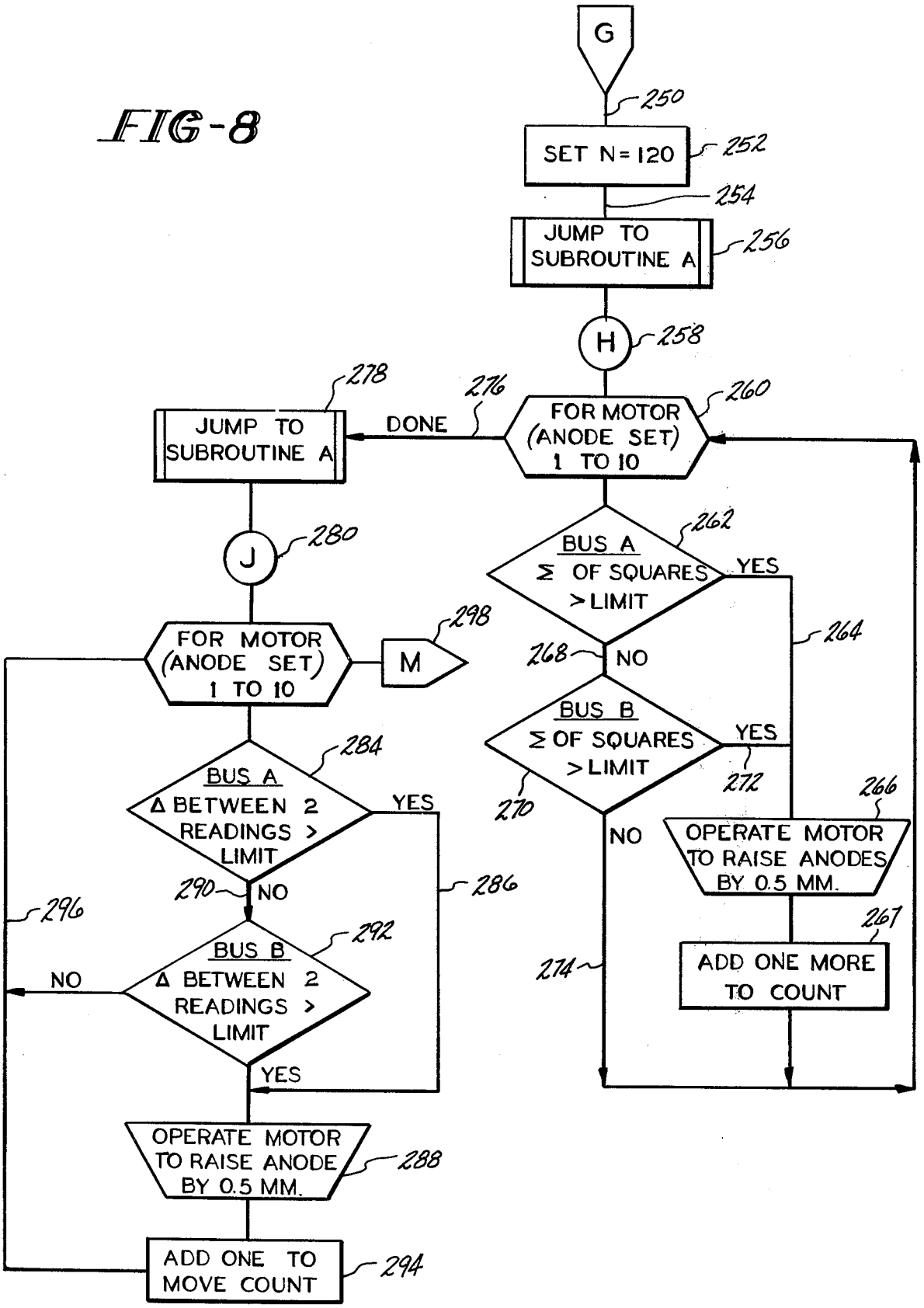

After the program has completed steps 186 to 212 on FIG. 6, the program proceeds along path 250 to point G in FIG. 8. At step 252 the program changes the period of time of reading current and voltage signals from one second to 4 seconds. As a result the number of readings N is increased from 30 to 120. The program then follows path 254 to step 256, where it jumps to subroutine A in FIG. 5 at point R. After completion of the subroutine A, the program returns to point H at 258, and then proceeds to step 260, where a specific anode set is selected for the selected cell.

The A Bus of the selected anode set is then selected in step 262, the difference between each successive current signal reading is recalled, the average sum of the squares is determined and compared with a predetermined limit. If the calculated sum of the squares value exceeds the limit, the program follows path 264 to step 266, where a signal is sent to motor control unit 8 to raise the anode set a distance of 0.5 mm.

The program proceeds to step 267 where "one" is added to the "motor" count, and the program returns by 274 to step 260. If the limit is not exceeded, the program follows path 268 to decision step 270 where the same analysis is made for companion bus bar B. If the limit is exceeded, the program follows path 272 to step 266 to raise the anodes. If the limit is not exceeded, or after the selected anode set has been raised, the program follows path 274 to step 260, where the next anode set in the cell is selected. After each anode set in the cell has been selected and analyzed in steps 260 to 274, the program follows path 276 to step 278, where it returns to subroutine A at point R.

After completion of subroutine A, the program returns to point J at 280 and proceeds to step 282, where a specific anode set is selected for the selected cell. The A bus is then selected in step 284 and the data for N readings of current signals is analyzed to determine whether the difference between any two readings of current signals in the series exceeded a predetermined limit. If the limit is exceeded, the program follows path 286 to step 288 where a signal is sent to motor control unit 8 to raise the anode set 0.5 mm. If the limit is not exceeded, the program follows path 290 to selection step 292 where B bus is selected and the data for N readings of current signals is analyzed to determine whether the difference between any two readings of current signals in the series exceeded a predetermined limit. If the limit is exceeded, program proceeds to step 288 for raising the anode set. After raising the anode set in step 288, the program proceeds to step 294 where "one" is added to the "anode set" count. The program then returns by path 296 to anode set selector step 282. In addition, if the limit is not exceeded in step 292 for B bus, the program also returns by path 296 to anode set selector step 282.

Figure 9:
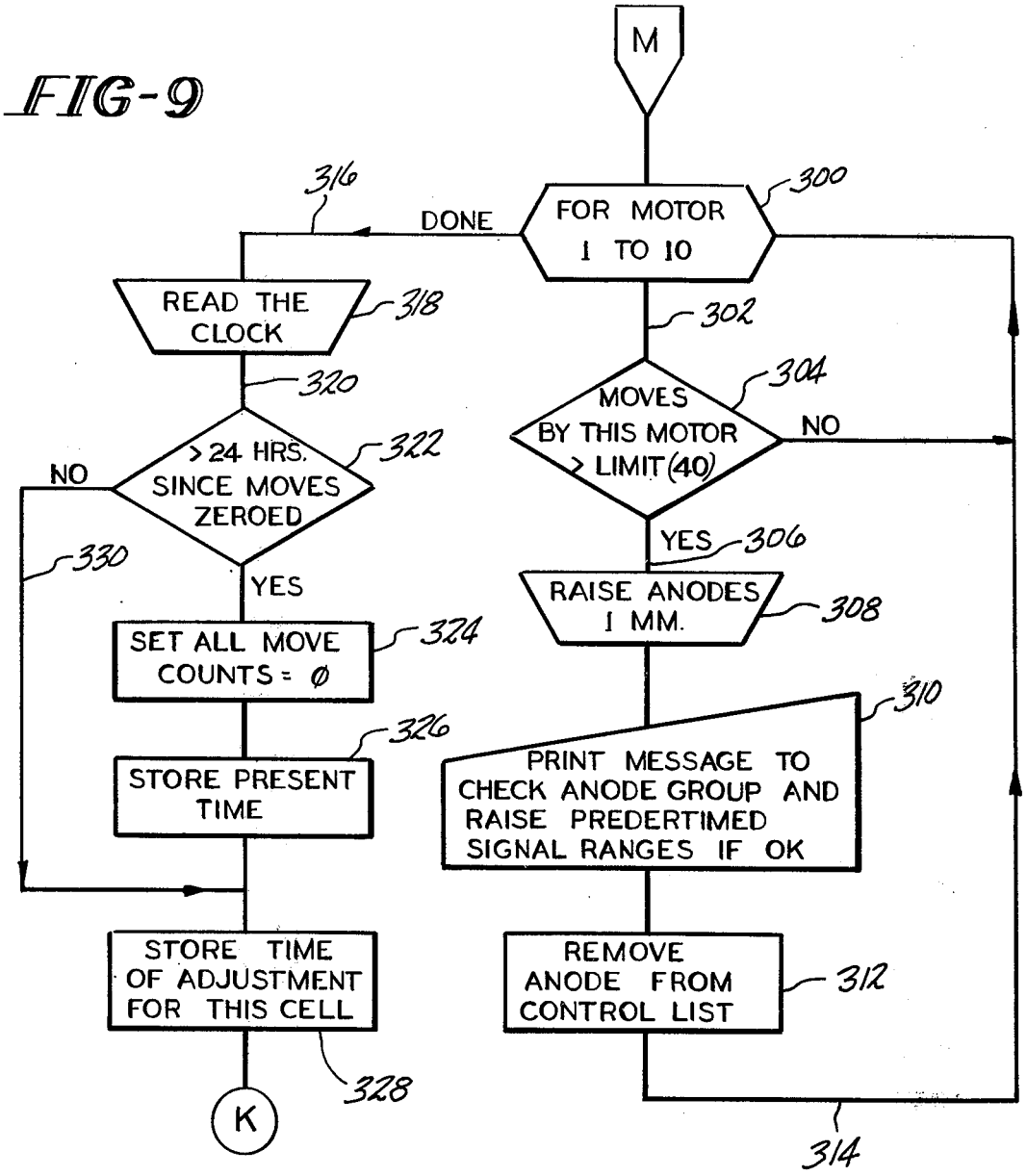

After steps 282–296 are completed, the program follows path 298 to point M in FIG. 9, and then to anode set motor selector step 300. A motor is selected for the cell, and the program then follows path 302 to decision step 304 where a determination is made of the frequency of moves of the anode set served by the motor for a given period. For example, if a limit of 40 moves per 24 hour period is exceeded, the program follows path 306 to step 308, where a signal is sent to motor control unit 8 to raise the anode set a distance of 1 mm. In addition, the program proceeds to step 310 where it types a message to the operator to check the specific anode set. If the anode set appears to be free of irregularities, the operator adjusts the predetermined current signal and voltage signal ranges for this anode set and it is returned to the control list. However, prior to checking by the operator, the program in step 312 removes the anode set from the control list to be checked by the program, and it then returns by path 314 to motor selector step 300. Similarly, if the limit of moves is not exceeded in step 304, the program returns by path 314 to motor selector 300 where the next motor is selected.

After completion of steps 300 to 314, the program moves by path 316 to step 318 where the clock is read. The program then moves by path 320 to step 322 where a determination is made whether a period of more than 24 hours have passed since the move counts were set to zero. If the 24 hour period has been exceeded, all move counts are set to zero in step 324, the time of resetting is recorded in step 326, the time of adjustment of the cell is made in step 328, and the program returns to point K in FIG. 4, for beginning the program. If the 24 hour period is not exceeded in step 322, the program follows path 330 to step 328, where it ultimately returns the program beginning at point K on FIG. 4.

The following examples are presented to define the invention more completely without any intention of being limited thereby. All parts and percentages are by weight, unless otherwise specified.

EXAMPLE 1

A horizontal mercury cathode cell for electrolyzing aqueous sodium chloride to produce chlorine containing 12 anode sets of 8 graphite anodes per set was equipped with the anode control system of FIG. 2. Current and voltage signals for all 12 anode sets were transmitted simultaneously to automatic control unit 6, a digital computer, for about 5 seconds until about 180 readings of current and of voltage were received for each anode set. The average voltage, current, and the difference between each current reading and the previous current reading was determined by the digital computer for the series of readings. The voltage coefficient was calculated for each anode set according to the formula:

$$Vc = V - 3.1/KA/M^2$$

Anode set 2, with a cathode surface area of 2.4 square meters, was found to have a Vc of 0.128, based on an average voltage of 4.38 and an average current reading of 12.0 kiloamperes. When Vc was compared with its standard coefficient S of 0.115, was found to have a value above the deviation range k, where k was ± 0.006. When the coefficient comparison determined the value of Vc was above S by a value greater than k, a signal from the computer activated a relay which energized a hydraulic motor to lower anode set 2 to decrease the anode-cathode spacing by 0.3 mm. Following the decrease in anode-cathode spacing, the following sequence of operations were performed:

1. A second set of about 15 measurements of current was taken for each conductor 15 to anode set 12 only and the difference between each measurement in each set was determined.
2. The first analysis compared the initial increase in current after decreasing the anode-cathode spacing with the maximum increase prior to the adjustment and was found to be within the predetermined limits.
3. A second set of about 15 current readings was taken and the second analysis for current fluctuation determined using the formula $\Sigma\Delta^2/N$. The fluctuation was found to fall within the predetermined limit of 0.5 percent.
4. A third analysis showed that the time since lowering the anode had not exceeded a fixed limit.
5. A fourth analysis revealed that the total increase in current did not exceed a predetermined limit of 7 percent.
6. The last reading was found to be larger than the previous reading and steps 3 to 5 were repeated with the same result. The latest reading was then found to be smaller than the previous reading indicating that the current to the anode set has stopped increasing. Readings were then taken for all anode sets on the cell and the Vc calculated for each was found to have a value within 5 percent of the stored value S. No further adjustments were made and the next cell to be adjusted was selected.

EXAMPLE 2

A group of horizontal mercury cathode cells for the electrolysis of sodium chloride were employed in this Example, each cell containing 10 anode sets, and each anode set contained 5 anodes. The anodes were constructed of titanium metal and partially coated with a noble metal compound. Each anode set was supplied with current by two conductors. The anode adjustment system of FIG. 2 was installed on the cells. Upon selection of one cell for possible adjustment of the anode-cathode spacing, a seris of 180 readings were taken simultaneously for all anode sets in the cell over a period of about 5 seconds. The current measurement was obtained by measuring the voltage drop between two terminals spaced 30 inches apart on each conductor and the voltage measurement was obtained between two corresponding terminals on each conductor supplying current to the corresponding anode set for the next adjacent cell. Thus, a group of 180 current measurements and 180 voltage measurements were obtained for each of the two conductors supplying an anode set and for all ten sets in the cell. Each group of measurements were signal conditioned and converted from analog to digital form and supplied to automatic control unit 6, a digital computer, where the average total current and voltage measurements were calculated and average total noise determined by summing the square of the difference between successive readings to each conductor and then averaging the 20 values for the cell. The voltage coefficient was calculated from the average total current and voltage readings obtained and then compared with a predetermined standard individually selected for each of the anode sets. Measurements of current and voltage taken for each set of anodes along with the calculated Vc and the predetermined standard Vc are given in Table I. From these results, it can be seen that none of the anode sets fell outside of the limits of k and therefore no adjustment of the anode-cathode spacing was required.

TABLE I

| Anode Set No. | Current in Kiloamperes: Conductor A | Current in Kiloamperes: Conductor B | Voltage: Conductor A | Voltage: Conductor B | Calculated Vc | Standard S |
|---|---|---|---|---|---|---|
| 1 | 6.86 | 6.38 | 4.44 | 4.47 | 0.154 | 0.150 |
| 2 | 7.15 | 7.93 | 4.41 | 4.55 | 0.137 | 0.130 |
| 3 | 7.71 | 7.92 | 4.44 | 4.48 | 0.131 | 0.130 |
| 4 | 7.40 | 7.74 | 4.46 | 4.48 | 0.136 | 0.130 |
| 5 | 7.51 | 7.44 | 4.46 | 4.48 | 0.138 | 0.130 |
| 6 | 7.88 | 7.31 | 4.46 | 4.51 | 0.137 | 0.130 |
| 7 | 7.47 | 7.47 | 4.48 | 4.46 | 0.137 | 0.130 |
| 8 | 7.25 | 7.75 | 4.48 | 4.47 | 0.137 | 0.130 |
| 9 | 7.57 | 7.38 | 4.41 | 4.48 | 0.135 | 0.130 |
| 10 | 6.96 | 6.16 | 4.41 | 4.40 | 0.149 | 0.140 |

Average Anode Set Current - 14.72 KA
Average Cell Voltage - 4.46
k = ± 0.010

EXAMPLE 3

Example 2 was repeated using a horizontal mercury cathode cell having graphite anodes. Table II shows the current and voltage measurements and the calculated Vc and standard S voltage coefficients. Deviation range k was ± 0.010. These results show no adjustment of the anode spacing for any of the 10 anode sets was required.

TABLE II

| Anode Set No. | Current in Kiloamperes: Conductor A | Current in Kiloamperes: Conductor B | Voltage: Conductor A | Voltage: Conductor B | Calculated Vc | Standard S |
|---|---|---|---|---|---|---|
| 1 | 5.93 | 5.55 | 4.93 | 5.00 | .244 | .244 |
| 2 | 7.44 | 7.35 | 4.92 | 4.95 | .186 | .188 |
| 3 | 8.35 | 8.51 | 4.91 | 4.95 | .163 | .168 |
| 4 | 8.10 | 7.63 | 4.91 | 5.02 | .178 | .179 |
| 5 | 7.90 | 7.85 | 4.90 | 4.92 | .172 | .180 |
| 6 | 7.80 | 7.98 | 4.89 | 4.91 | .171 | .175 |
| 7 | 8.09 | 7.66 | 4.89 | 4.89 | .170 | .169 |
| 8 | 7.31 | 7.37 | 4.91 | .185 | .181 | |
| 9 | 7.14 | 7.80 | 4.89 | 4.94 | .182 | .179 |
| 10 | 6.40 | 6.76 | 4.89 | 4.90 | .205 | .198 |

Average Anode Set Current - 14.98 KA
Average Cell Voltage - 4.92
k = ± 0.010

In Example 3, as well as Example 2, electric motors were used as the motor drive means which received electric signals from the digital computer to adjust the anodes when necessary.

What is claimed is:

1. Apparatus for adjusting the space between electrodes in an electrolytic cell, said electrodes being comprised of at least one adjustable anode set, at least one conductor feeding current to said anode set, and a liquid cathode in spaced relationship with said anode set, said apparatus comprising in combination:

a. digital computer means programmed with predetermined standard signal ranges for current signals for each of said conductors, b. means for detecting a series of N current signals to each of said conductor over a predetermined period, c. means for selecting from said detected signals a set of selected signals generated from one of said conductors to one of said anode sets, d. means for supplying said selected signals in digital form to said digital computer means, e. means for comparing said selected signals with said predetermined standard signal ranges for said selected conductor from said selected anode set programmed in said digital computer, f. means in said digital computer for generating activating electric signals when said selected signals in digital form are outside of said predetermined standard signal ranges, and g. motor means operative to raise or lower said selected anode set, said motor means being energized by said activating electric signals when said selected signals are outside said standard signal ranges.

2. The apparatus of claim 1 wherein said electrodes are comprised of a plurality of adjustable anode sets.

3. The apparatus of claim 2 having in combination:

a. means for reactivating said means b. through f. immediately after said motor means is activated to lower said anode set, and b. means for storing the previously detected signals obtained prior to lowering said selected anode set and means for comparing newly selected signals with said previously selected signals.

4. The apparatus of claim 3 wherein said digital computer means is provided with means for comparing each of said selected current signal with the previous current signal in said series and raising said anode when the difference in current is an increase which exceeds a predetermined limit.

5. The apparatus of claim 3 wherein said digital computer means is provided with means for obtaining the average difference in said current measurements in said series of N current signals, means for comparing said average difference with a predetermined average difference limit and means for raising said anode when said average difference exceeds said predetermined average difference limit.

6. The apparatus of claim 5 wherein said means for obtaining said average difference is program means which obtains the difference between each successive current measurement in said N current measurements, squares each difference to obtain a product, adds each resulting product and divides the resulting sum by N to obtain said average difference.

7. The apparatus of claim 3 wherein said digital computer means is provided with means for increasing said anode-cathode spacing when the difference in current increases in each successive measurement in said N current signals throughout said predetermined period.

8. The apparatus of claim 3 wherein said digital computer means is provided with a means for increasing said anode-cathode spacing when the difference between any two current signals in said N series exceeds a predetermined limit during said predetermined period.

9. The apparatus of claim 3 wherein said digital computer means is provided with means for counting the frequency of change in each anode-cathode spacing for each anode set for a predetermined period and when said frequency exceeds a predetermined number, means for raising the anode set and removing it from automatic control.

10. The apparatus of claim 9 wherein said frequency of change is from about 20 to about 80 changes over a 24 hour period.

11. The apparatus of claims 1–10 wherein temperature compensating means is secured to each of said conductors to adjust said current signals for temperature variations.

12. The apparatus of claim 11 wherein said temperature compensation means is a thermistor circuit.

* * * * *

UNITED STATES PATENT AND TRADEMARK OFFICE

CERTIFICATE OF CORRECTION

PATENT NO. : 4,155,829

DATED : May 22, 1979

INVENTOR(S) : Richard W. Ralston, Jr.

It is certified that error appears in the above-identified patent and that said Letters Patent are hereby corrected as shown below:

Column 9, line 55, delete "inroduced" and insert --introduced--.

Column 22, Example 2, line 37, delete "seris" and insert --series--.

Column 23, Table II, under the section entitled "Voltage Conductor B", after "4.89" delete ".185" and insert --4.91--.

Column 23, Table II, under the section entitled "Calculated Vc", after ".170" delete ".181" and insert --.185--.

Column 23, Table II, under the section entitled "Standard S", after ".169" insert --.181--.

Signed and Sealed this

*Fourth* Day of *December 1979*

[SEAL]

*Attest:*

SIDNEY A. DIAMOND

*Attesting Officer*

*Commissioner of Patents and Trademarks*